US010496010B2

(12) United States Patent
Kuramoto et al.

(10) Patent No.: US 10,496,010 B2
(45) Date of Patent: Dec. 3, 2019

(54) DEVELOPING DEVICE AND IMAGE FORMING APPARATUS

(71) Applicant: FUJI XEROX CO., LTD., Tokyo (JP)

(72) Inventors: Shinichi Kuramoto, Kanagawa (JP); Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/111,222

(22) Filed: Aug. 24, 2018

(65) Prior Publication Data

US 2019/0294077 A1 Sep. 26, 2019

(30) Foreign Application Priority Data

Mar. 20, 2018 (JP) ..... 2018-053464

(51) Int. Cl.
*G03G 15/08* (2006.01)

(52) U.S. Cl.
CPC ..... *G03G 15/0865* (2013.01); *G03G 15/0887* (2013.01)

(58) Field of Classification Search
CPC ..... G03G 15/0822; G03G 15/0812; G03G 15/0865; G03G 15/0887
See application file for complete search history.

(56) References Cited

U.S. PATENT DOCUMENTS

| | | | | |
|---|---|---|---|---|
| 7,991,318 | B2 * | 8/2011 | Tamura | G03G 15/0815 399/274 |
| 9,804,531 | B2 * | 10/2017 | Fujimori | G03G 15/081 |
| 10,088,771 | B1 * | 10/2018 | Kuramoto | G03G 15/0808 |
| 2015/0016848 | A1 * | 1/2015 | Ishii | G03G 15/0896 399/279 |
| 2015/0093139 | A1 * | 4/2015 | Kuramoto | G03G 15/0806 399/92 |
| 2016/0306291 | A1 * | 10/2016 | Kuroda | G03G 15/0844 |
| 2018/0267427 | A1 * | 9/2018 | Kuramoto | G03G 15/0822 |
| 2018/0284655 | A1 * | 10/2018 | Hori | G03G 15/0865 |

FOREIGN PATENT DOCUMENTS

| | | |
|---|---|---|
| JP | 2005346035 | 12/2005 |
| JP | 2008039965 | 2/2008 |

* cited by examiner

*Primary Examiner* — Francis C Gray
(74) *Attorney, Agent, or Firm* — JCIPRNET

(57) ABSTRACT

A developing device includes an accommodating section that accommodates a developer; a developing section; a transporting section that is disposed below the developing section in a gravitational direction; a flow channel portion that extends from an inner side to an outer side of the accommodating section; a first wall portion that extends towards the transporting section at an end portion on an inner side of the flow channel portion; and a second wall portion that extends towards the transporting section at the end portion on the inner side of the flow channel portion, a distance from the second wall portion to an outer peripheral edge of the transporting section being greater than or equal to a distance from the first wall portion to the outer peripheral edge of the transporting section.

11 Claims, 6 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2018-053464 filed Mar. 20, 2018.

BACKGROUND

Technical Field

The present invention relates to a developing device and an image forming apparatus.

SUMMARY

According to an aspect of the invention, there is provided a developing device including an accommodating section that accommodates a developer; a developing section that rotates such that an upper portion thereof in a gravitational direction moves from an outer side of the accommodating section to an inner side of the accommodating section, the developing section performing developing on an image holding body with the developer; a transporting section that is disposed below the developing section in the gravitational direction and that transports the developer in an inside of the accommodating section; a flow channel portion that extends from the inner side of the accommodating section to the outer side of the accommodating section; a first wall portion that extends towards the transporting section at an end portion on an inner side of the flow channel portion and that faces the developing section; and a second wall portion that extends towards the transporting section at the end portion on the inner side of the flow channel portion and that faces the first wall portion on a side opposite to the developing section, a distance from the second wall portion to an outer peripheral edge of the transporting section being greater than or equal to a distance from the first wall portion to the outer peripheral edge of the transporting section.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
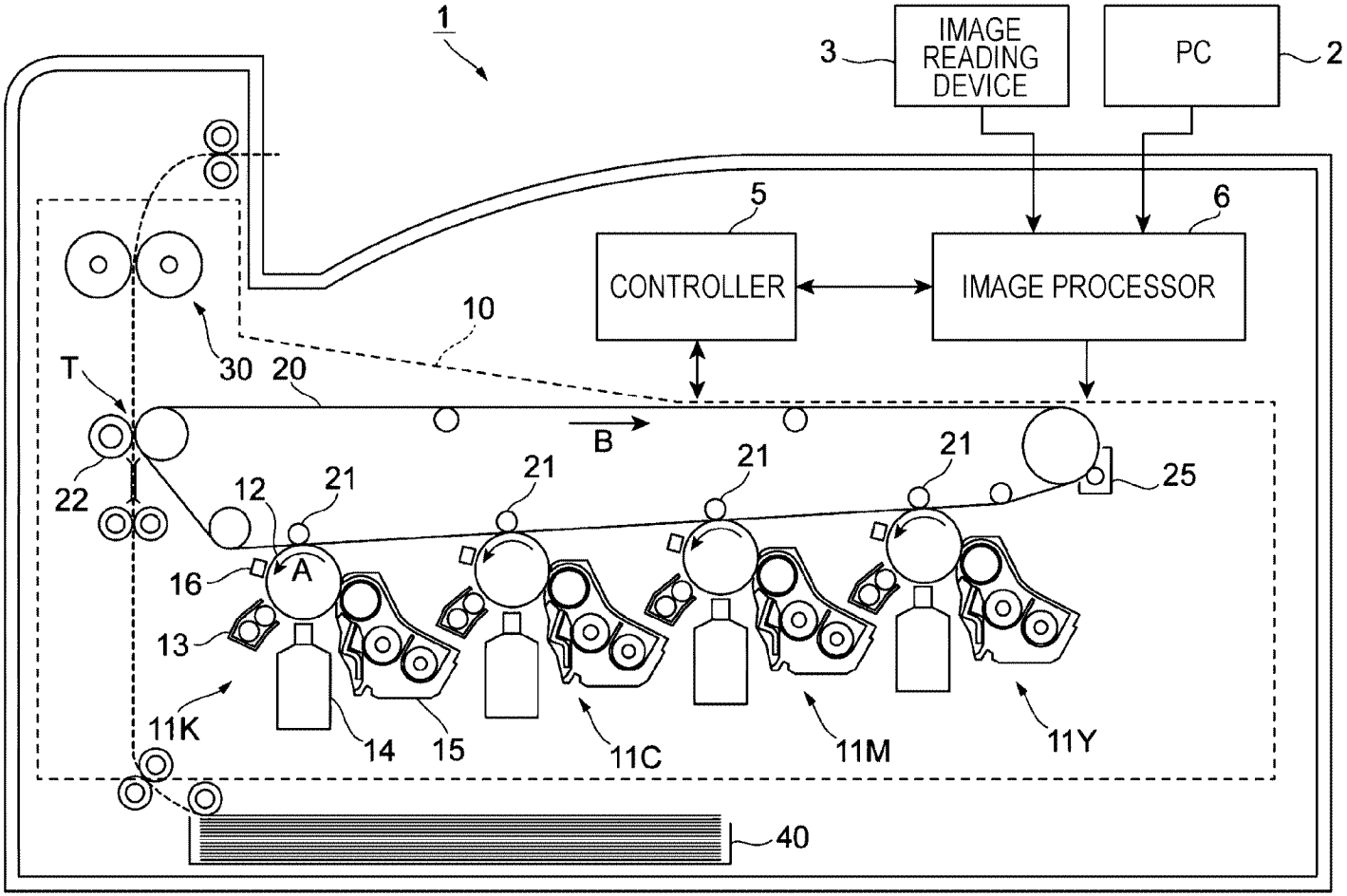
FIG. 1 illustrates an entire structure of an image forming apparatus to which a first exemplary embodiment is applied.

Exemplary embodiments of the present invention are described in detail below with reference to the attached drawings. FIG. 1 illustrates an entire structure of an image forming apparatus 1 to which a first exemplary embodiment is applied.

The image forming apparatus 1 is a generally so-called tandem image forming apparatus. The image forming apparatus 1 includes an image forming section 10 that forms images in correspondence with pieces of image data for respective colors; a controller 5, which is an example of a controlling unit, that controls the operation of the entire image forming apparatus 1; and a sheet holding section 40 that holds sheets that are supplied to the image forming apparatus 1. The image forming apparatus 1 also includes, for example, an image processor 6 that performs predetermined image processing on the pieces of image data received from, for example, a personal computer (PC) 2 or an image reading device 3.

The image forming section 10 includes four image forming units 11Y, 11M, 11C, and 11K (also generically called "image forming units 11") that are arranged side by side at certain intervals. Each image forming unit 11 includes a photoconductor drum 12, which is an example of an image holding body, on which an electrostatic latent image is formed and that holds a toner image; a charging unit 13 that charges the surface of the photoconductor drum 12 with a predetermined potential; an exposing device 14 that exposes the photoconductor drum 12 charged by the charging unit 13 on the basis of the image data for the corresponding color; a developing device 15 that develops the electrostatic latent image formed on the corresponding photoconductor drum 12; and a drum cleaner 16 that cleans the surface of the corresponding photoconductor drum 12 after transfer.

The image forming units 11 have substantially the same structure except that the developers that their developing devices 15 accommodate differ from each other. Each of the image forming units 11 forms a corresponding one of a yellow (Y) toner image, a magenta (M) toner image, a cyan (C) toner image, and a black (K) toner image.

In addition, the image forming section 10 includes an intermediate transfer belt 20 that is subjected to multiple transfer of the toner images of the respective colors formed on the photoconductor drums 12 of the respective image forming units 11, and first transfer rollers 21 that successively transfer (first-transfer) the toner images of the respective colors formed at the respective image forming units 11 onto the intermediate transfer belt 20. The image forming section 10 further includes a second transfer roller 22 that collectively transfers (second-transfers) the toner images of the respective colors superimposed upon and transferred onto the intermediate transfer belt 20 onto a sheet, which is a recording material (recording paper); a belt cleaner 25 that cleans a surface of the intermediate transfer belt 20 after the second transfer; and a fixing device 30 that fixes the second-transferred toner images of the respective colors to the sheet P.

In the image forming apparatus 1, the image forming section 10 performs an image forming operation on the basis of various control signals that are supplied from the controller 5. That is, under control by the controller 5, the pieces of image data input from the PC 2 and the image reading device 3 are subjected to the image processing by the image processor 6, and are supplied to the respective image forming units 11. Then, at each of the image forming units 11, the charging unit 13 charges the corresponding photoconductor drum 12, the exposing device 14 exposes the corresponding charged photoconductor drum 12, and the developing device 15 develops the corresponding electrostatic latent image, so that the toner image of the corresponding color is formed on the surface of the corresponding photoconductor drum 12.

Then, the toner images of the respective colors formed on the respective photoconductor drums 12 are successively transferred onto the intermediate transfer belt 20 by the respective first transfer rollers 21.

Then, a synthetic toner image on the intermediate transfer belt 20 is transported to a region where the second transfer roller 22 is disposed (second transfer section T) due to the movement of the intermediate transfer belt 20. When the synthetic toner image is transported to the second transfer section T, a sheet is supplied to the second transfer section T from the sheet holding section 40 in accordance with a timing in which the synthetic toner image is transported to the second transfer section T. Then, a transfer electric field that is produced by the second transfer roller 22 at the second transfer section T causes the synthetic toner image to be collectively electrostatically transferred onto the transported sheet.

Thereafter, the sheet onto which the synthetic toner image has been transferred is transported to the fixing device 30, and is subjected to fixing processing by using heat and pressure, so that the toner image is fixed to the sheet. Then, the sheet to which the toner image has been fixed is transported to a sheet-stacking section of the image forming apparatus 1.

On the other hand, any toner on the intermediate transfer belt 20 after the second transfer is removed by the belt cleaner 25 from the surface of the intermediate transfer belt 20 after the completion of the second transfer. In this way, the image formation at the image forming apparatus 1 is repeatedly executed for cycles corresponding to the number of prints.

Figure 2:
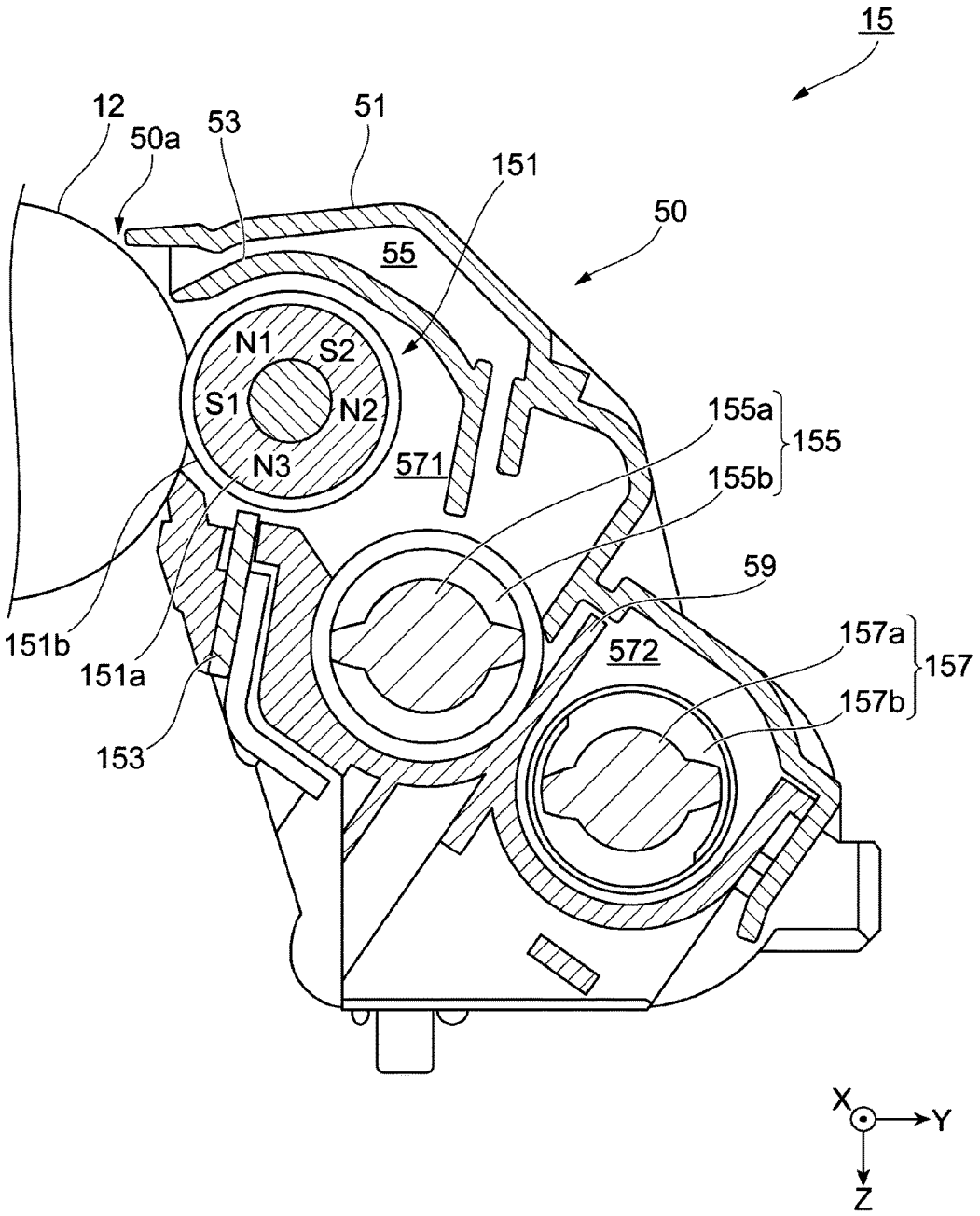
FIG. 2 illustrates a structure of a developing device to which the first exemplary embodiment is applied.

Next, a structure of each developing device 15 is described. FIG. 2 illustrates a structure of a developing device 15 to which the first exemplary embodiment is applied.

The developing device 15 of the exemplary embodiment develops an electrostatic latent image formed on the photoconductor drum 12 by using, for example, a so-called two-component developer (hereunder simply called "developer") whose main components are toner and carriers. The toner is charged to a negative polarity. The carriers are charged to a positive polarity and are magnetic.

As shown in FIG. 2, the developing device 15 includes a developing housing 50 that has an opening 50*a* facing the photoconductor drum 12 and that accommodates a developer therein, a developing roller 151 that is disposed at a portion facing the opening 50*a* of the developing housing 50 and that faces the photoconductor drum 12, and a layer regulating member 153 that regulates the thickness of the developer held by an outer peripheral surface of the developing roller 151.

The developing device 15 also includes a pair of first transporting member 155 and second transporting member 157 that transport the developer accommodated in the inside of the developing housing 50 while stirring the developer.

Here, in the description below, a direction along a rotation axis of the developing roller 151 (direction from a rear side to a front side of the image forming apparatus 1 (see FIG. 1)) is called an X direction. A gravitational direction in a downward direction in FIG. 2 is called a Z direction. A direction that is a direction from left to right and that is perpendicular to the X direction and the Z direction is called a Y direction.

The developing roller 151 is an example of a developing section, and supplies the developer to the photoconductor drum 12 on which an electrostatic image is formed while holding the developer on the outer peripheral surface thereof and rotating. The developing roller 151 includes a magnet roller 151*a* and a developing sleeve 151*b*.

The developing sleeve 151*b* has a cylindrical shape, and is disposed so as to be rotatable in the direction of arrow C (see FIG. 3 described later) by using a driving mechanism (not shown). The direction of rotation of the developing roller 151 in the description of the exemplary embodiment refers to the direction of rotation of the developing sleeve 151*b*. A developing power supply (not shown) that supplies developing voltage is connected to the developing sleeve 151*b*.

The magnet roller 151*a* has a columnar shape, and is disposed at an inner periphery of the developing sleeve 151*b* so as not to rotate.

The magnet roller 151*a* includes multiple magnets. More specifically, a developing pole S1, a first transporting pole N1 and a second transporting pole S2, a separating pole N2, and a layer forming pole N3 are successively disposed in a circumferential direction at the magnet roller 151*a*. The developing pole S1 causes toner to be transferred onto the photoconductor drum 12 and the electrostatic latent image to be developed. The first transporting pole N1 and the second transporting pole S2 cause a developer layer to be transported. The separating pole N2 causes the developer to be separated from the developing sleeve 151*b*. The layer forming pole N3 causes the developer accommodated in the developing housing 50 to be drawn up, causes, along with the layer regulating member 153, the thickness of the developer to be regulated, and causes the developer layer having a predetermined thickness to be formed on an outer peripheral surface of the developing sleeve 151*b*.

The layer regulating member 153 regulates the amount of developer that passes between the developing roller 151 and the layer regulating member 153 to form the developer layer having the predetermined thickness on the developing roller 151. The layer regulating member 153 faces the developing roller 151 from a lower side in the gravitational direction (downstream side in the Z direction). The layer regulating member 153 and the outer peripheral surface of the developing roller 151 are disposed such that a predetermined gap is formed along an axial direction of the developing roller 151 (X direction).

The first transporting member 155, which is an example of a transporting section, includes a columnar first shaft section 155*a* with the X direction being its axial direction and a spiral first blade section 155*b* that is formed on an outer periphery of the first shaft section 155*a*. Similarly, the second transporting member 157 includes a columnar second shaft section 157*a* with the X direction being its axial direction and a spiral second blade section 157*b* that is formed on an outer periphery of the second shaft section 157*a*.

In the developing device 15, the rotation of the first transporting member 155 and the rotation of the second transporting member 157 cause the developer to circulate and to be transported in the inside of the developing housing 50.

Figure 3:
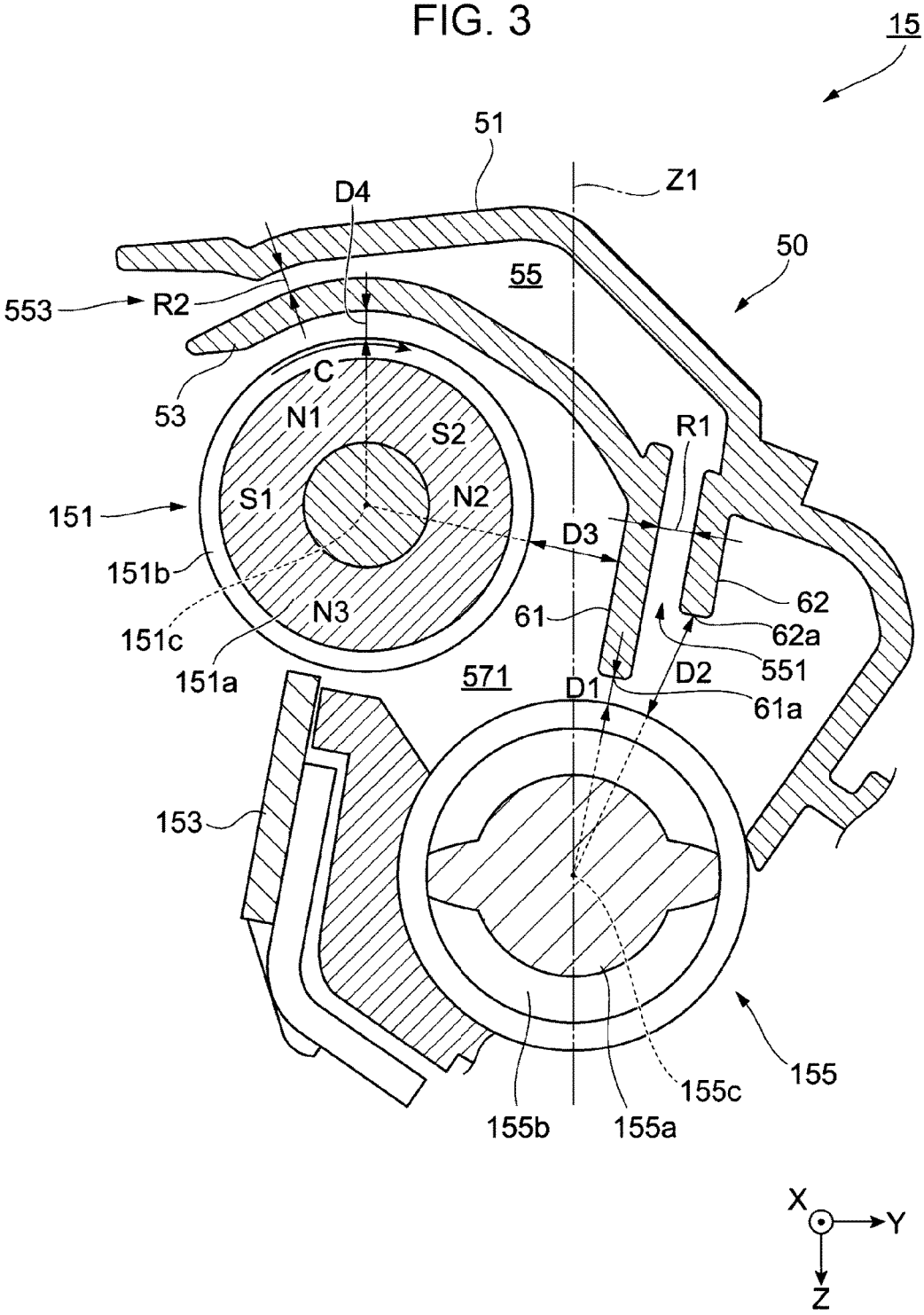
FIG. 3 is an enlarged view of an upper portion (downstream side in a Z direction) in FIG. 2.

Next, the developing housing 50 is described. FIG. 3 is an enlarged view of an upper portion (downstream side in the Z direction) in FIG. 2.

The developing housing 50 of the exemplary embodiment has in its entirety an elongated shape extending in the axial direction of the photoconductor drum 12 (X direction). As shown in FIGS. 2 and 3, the developing housing 50 includes an outer wall portion 51 that forms an outermost contour of the developing housing 50 and that accommodates, for example, each component of the developing device 15 therein.

The developing housing 50 also includes a partition wall 59 and a first stirring chamber 571 and a second stirring chamber 572 in the inside thereof surrounded by the outer wall portion 51. The partition wall 59 extends along the X direction. The first stirring chamber 571 and the second stirring chamber 572 are examples of accommodating sections that are separated by the partition wall 59. In this example, as shown in FIG. 2, the first stirring chamber 571 is disposed closer than the second stirring chamber 572 to the photoconductor drum 12. Openings (not shown) are formed on two respective ends of the partition wall 59 in the X direction, and the first stirring chamber 571 and the second stirring chamber 572 are connected to each other at the two ends in the X direction. The first transporting member 155 described above is provided in the first stirring chamber 571 so as to be rotatable with the X direction as an axis. The second transporting member 157 described above is provided in the second stirring chamber 572 so as to be rotatable with the X direction as an axis. In the first stirring chamber 571 and the second stirring chamber 572, the developer is circulated and transported by the rotation of the first transporting member 155 and the rotation of the second transporting member 157.

Further, the developing housing 50 includes an inner wall portion 53, which is an example of a facing portion, that is provided between the outer wall portion 51 and the outer peripheral surface of the developing roller 151. As shown in FIG. 3, the inner wall portion 53 faces a region of the outer peripheral surface of the developing roller 151 that is positioned on an upper side in the gravitational direction (upstream side in the Z direction) with a predetermined gap therebetween. The inner wall portion 53 has a curved surface in accordance with the shape of the outer peripheral surface of the developing roller 151. Further, one X-direction end portion of the inner wall portion 53 (left end portion in FIG. 3) is exposed to the outside of the developing housing 50 via the opening 50*a*.

The developing housing 50 includes a first wall portion 61 extending towards an outer peripheral edge of the first transporting member 155 from the other end portion (right end portion in FIG. 3) of the inner wall portion 53 that is positioned in the inside of the developing housing 50. In other words, the first wall portion 61 is formed continuously from the inner wall portion 53. The outer peripheral edge of the first transporting member 155 refers to an outermost portion of the first blade section 155*b* when the first transporting member 155 is projected along the axial direction (X direction).

The developing housing 50 also includes a second wall portion 62 that faces the first wall portion 61 with a predetermined gap therebetween and that extends towards the outer peripheral edge of the first transporting member 155 from the outer wall portion 51. In other words, the second wall portion 62 is formed continuously from the outer wall portion 51. In this example, the first wall portion 61 and the second wall portion 62 are formed from planar surfaces that are parallel to each other.

In the developing housing 50, a flow channel portion 55 for discharging a gas to the outside of the developing housing 50 from the inside of the developing housing 50 is formed between the first wall portion 61, the inner wall portion 53, the second wall portion 62, and the outer wall portion 51. The flow channel portion 55 includes an entrance section 551 where the first wall portion 61 and an end portion 62*a* (described later) of the second wall portion 62 face each other and into which a gas flows from the inside of the developing housing 50. The flow channel portion 55 also includes an exit section 553 where the inner wall portion 53 and the outer wall portion 51 face each other, that is exposed to the outside of the developing device 15 via the opening 50*a*, and that is used for discharging a gas to the outside of the developing device 15.

As shown in FIG. 3, the flow channel portion 55 is formed on a side opposite to the developing roller 151 with the inner wall portion 53 interposed therebetween, and so as to extend above the developing roller 151 in the gravitational direction in accordance with the outer peripheral surface of the developing roller 151. In the exemplary embodiment, by forming the flow channel portion 55 with such a shape, it is possible to ensure the length of the flow channel portion 55 while suppressing an increase in the size of the developing device 15.

Although described in detail later, in each developing device 15 of the exemplary embodiment, a gas is discharged from the inside of the developing housing 50 via the flow channel portion 55 to suppress an increase in the internal pressure of the developing housing 50.

As shown in FIG. 3, an end portion of the first wall portion 61 on a side opposite to a side that is connected to the inner wall portion 53 (lower end portion in the gravitational direction; indicated by symbol 61*a* in FIG. 3) faces the outer peripheral edge of the first transporting member 155 with a gap therebetween.

Similarly, the end portion of the second wall portion 62 on a side opposite to a side that is connected to the outer wall portion 51 (lower end portion in the gravitational direction; indicated by symbol 62*a* in FIG. 3) faces the outer peripheral edge of the first transporting member 155 with a gap therebetween.

As shown in FIG. 3, a distance D1 from the first wall portion 61 to the outer peripheral edge of the first transporting member 155 is smaller than a distance D2 from the second wall portion 62 to the outer peripheral edge of the first transporting member 155 (01<D2). Here, the distance D1 from the first wall portion 61 to the outer peripheral edge of the first transporting member 155 refers to a distance between the end portion 61*a* of the first wall portion 61 and the outer peripheral edge of the first transporting member 155 on a line connecting the end portion 61*a* of the first wall portion 61 and a rotational center 155*c* of the first transporting member 155. Similarly, the distance D2 from the second wall portion 62 to the outer peripheral edge of the first transporting member 155 refers to a distance between the end portion 62*a* of the second wall portion 62 and the outer peripheral edge of the first transporting member 155 on a line connecting the end portion 62*a* of the second wall portion 62 and the rotational center 155*c* of the first transporting member 155.

Further, the end portion 61*a* of the first wall portion 61 is positioned below a rotational center 151*c* of the developing roller 151 (developing sleeve 151*b*) in the gravitational direction (downstream side in the Z direction).

Although described in detail later, by providing such a structure, compared to when the end portion 61*a* of the first wall portion 61 of the first wall portion 61 is positioned above the rotational center 151*c* of the developing roller 151 in the gravitational direction, entry into the flow channel portion 55 of a developer separated from the developing roller 151 by the action of the separating pole N2 is suppressed.

Further, the end portion 61*a* of the first wall portion 61 is positioned on a side opposite to the developing roller 151 with respect to a perpendicular line Z1 passing through the rotational center of the first transporting member 155 and extending in the gravitational direction (Z direction).

Although described in detail below, by providing such a structure, compared to when the end portion 61*a* of the first wall portion 61 is positioned on the same side as the developing roller 151 with respect to the perpendicular line Z1, a case in which the developer that has been separated from the developing roller 151 by the action of the separating pole N2 and that has struck the first wall portion 61 adheres again to the developing roller 151 is suppressed.

The first wall portion 61 is inclined in the gravitational direction (Z direction) away from the developing roller 151 from the end portion 61*a* towards a connection portion of the end portion 61*a* and the inner wall portion 53. In the exemplary embodiment, the angle between the first wall portion 61 and the gravitational direction is approximately 10 degrees. The angle between the first wall portion 61 and the gravitational direction is capable of being determined in accordance with, for example, the distance D1 from the first wall portion 61 to the outer peripheral edge of the first transporting member 155 or a distance D3 (described later) between the first wall portion 61 and the developing roller 151. This angle may be, for example, in the range of 5 degrees to 20 degrees.

Although described in detail below, by providing such a structure, compared to a case in which the first wall portion 61 is provided along the gravitational direction, a case in which a developer separated from the developing roller 151 by the action of the separating pole N2 tends to strike the first wall portion 61 and enters the flow channel portion 55 is suppressed.

A distance R1 between the first wall portion 61 and the second wall portion 62 (width of the entrance section 551 of the flow channel portion 55) may, for example, be determined in accordance with, for example, the particle size of the carriers used in the developer and the gas discharge capability demanded from the flow channel portion 55. The distance R1 between the first wall portion 61 and the second wall portion 62 may be, for example, in the range of 0.5 mm to 10 mm. When the distance R1 between the first wall portion 61 and the second wall portion 62 is too small, the flow channel portion 55 tends to be clogged by the developer at a location between the first wall portion 61 and the second wall portion 62, and discharge of a gas via the flow channel portion 55 may become difficult. In contrast, when the distance R1 between the first wall portion 61 and the second wall portion 62 is too large, the developer tends to enter the flow channel portion 55 via the location between the first wall portion 61 and the second wall portion 62, and the developer tends to be discharged to the outside of the developing device 15 via the flow channel portion 55.

In this example, the distance R1 between the first wall portion 61 and the second wall portion 62 is smaller than the distance D3 between the first wall portion 61 and the developing roller 151. In other words, the distance D3 between the first wall portion 61 and the developing roller 151 is larger than the distance R1 between the first wall portion 61 and the second wall portion 62. The distance D3 between the first wall portion 61 and the developing roller 151 refers to a distance between the first wall portion 61 and the outer peripheral surface of the developing roller 151 on a perpendicular line extending from the rotational center 151*c* of the developing roller 151 to the first wall portion 61.

By providing such a structure, for example, compared to when the distance D3 between the first wall portion 61 and the developing roller 151 is less than or equal to the distance R1 between the first wall portion 61 and the second wall portion 62, a case in which the developer that has been separated from the developing roller 151 by the action of the separating pole N2 and that has struck the first wall portion 61 adheres again to the developing roller 151 is suppressed.

In this example, the distance R1 between the first wall portion 61 and the second wall portion 62 is about the same as a distance R2 between the inner wall portion 53 and the outer wall portion 51, which form the flow channel portion 55, (width of the exit section 553 of the flow channel portion 55).

In this example, the distance R1 between the first wall portion 61 and the second wall portion 62 is about the same as a distance D4 between the developing roller 151 and the inner wall portion 53. Here, in the exemplary embodiment, the distance between the developing roller 151 and the inner wall portion 53 refers to a distance between the inner wall portion 53 and a portion of the outer peripheral surface of the developing roller 151 (developing sleeve 151*b*) that is positioned on an uppermost portion in the gravitational direction.

Next, the developing operation by the developing device 15 is described.

In the developing device 15, the first transporting member 155 and the second transporting member 157 rotate, and a developer is stirred and transported in the developing housing 50. By the stirring and the transporting, toner and carriers of the developer rub against each other, and the toner is charged with a negative polarity, and the carriers are charged with a positive polarity. As a result, in the developer that is stirred and transported, the toner is in a state in which it is electrostatically attracted to the carriers. Then, when the developer that is stirred and transported reaches a facing portion facing the developing roller 151, a magnetic force acts between the magnet roller 151*a* of the developing roller 151 and the carriers, and some of the carriers are transferred towards the developing roller 151. At this time, since the toner is electrostatically attracted to the carriers that are transferred, the developer is transferred towards the developing roller 151.

In the developing device 15, the developing sleeve 151*b* rotates in the direction of arrow C. Therefore, the developer transferred to the developing sleeve 151*b* is transported due to the rotation of the developing sleeve 151*b*. Then, the thickness of the developer on the developing sleeve 151*b* is regulated when it passes a facing portion facing the layer regulating member 153. By this, a developer layer whose layer thickness has been regulated is formed on the developing sleeve 151*b*. The developer whose thickness has been regulated by the layer regulating member 153 and that has been separated from the developing sleeve 151*b* is returned to the first stirring chamber 571 by gravitational force.

Next, the developer layer formed by the layer regulating member 153 moves to a development region, where the photoconductor drum 12 and the developing roller 151 face each other, due to the rotation of the developing sleeve 151*b*. Here, in the developing device 15, a predetermined development voltage is applied to the developing sleeve 151*b*. By this, in the development region, the toner is electrostatically transferred to an image portion on the photoconductor drum 12 from the developer layer on the developing sleeve 151*b*, and an electrostatic latent image is developed and made visible.

Thereafter, the developer layer on the developing sleeve 151*b* that has passed the development region is returned to the inside of the developing housing 50 due to the rotation of the developing sleeve 151*b*. Then, the developer layer on the developing sleeve 151*b* returned to the inside of the developing housing 50 separates from the developing roller 151 and falls into the first stirring chamber 571 by the action of the separating pole N2 of the magnet roller 151*a*. The fallen developer is stirred and transported again by the first transporting member 155 and the second transporting member 157, and a next developing operation is waited for.

Figure 4:
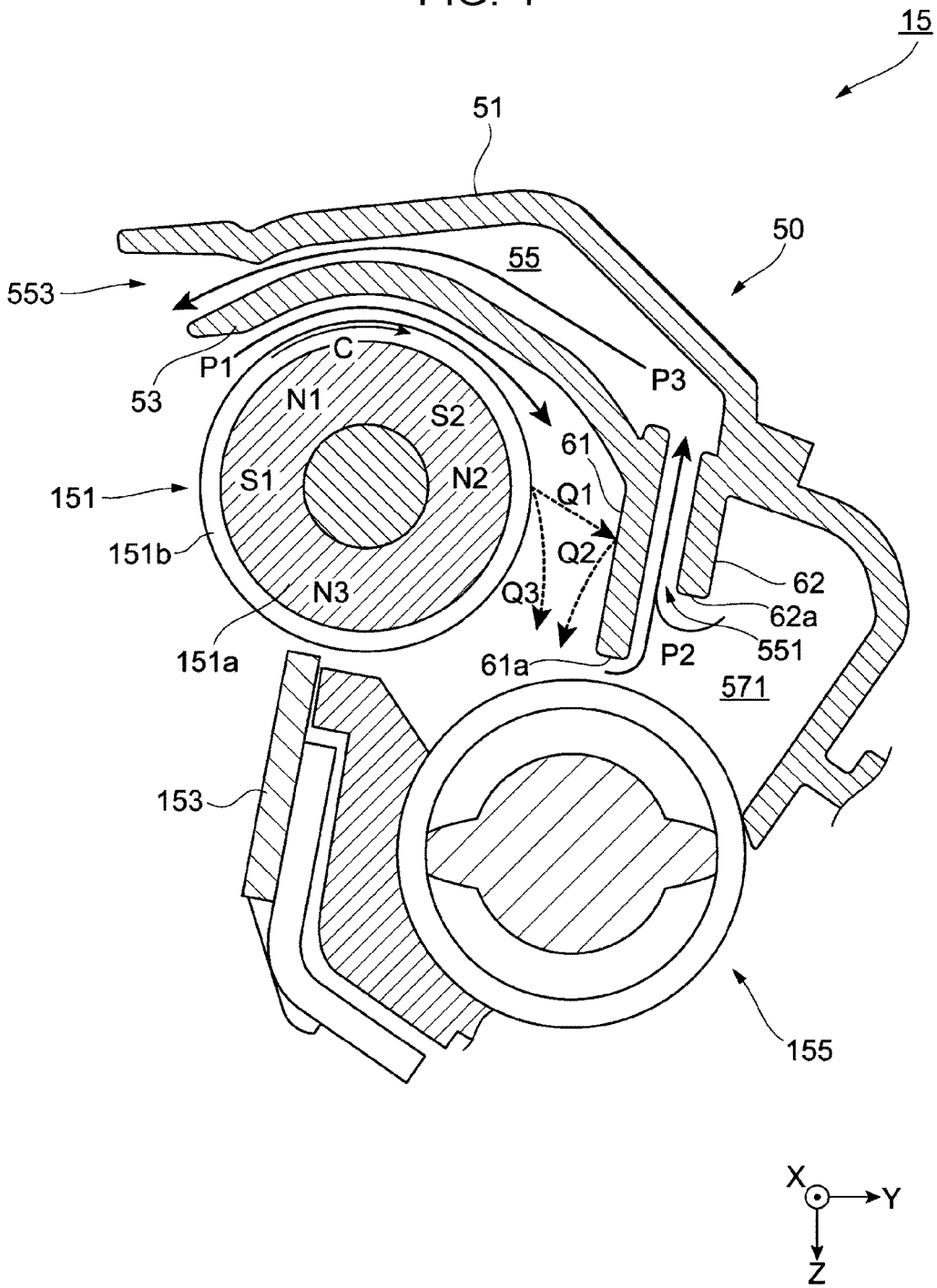
FIG. 4 illustrates, for example, the behavior of gas in the developing device of the first exemplary embodiment.

Next, the flow of gas in the developing device 15 when it performs a developing operation is described. FIG. 4 illustrates, for example, the behavior of gas in the developing device 15 of the first exemplary embodiment.

As described above, when performing a developing operation, the developing roller 151 (developing sleeve 151*b*) rotates in the direction of arrow C. Due to the rotation, at an upper portion of the developing roller 151 in the gravitational direction, as indicated by arrow P1, an air current is produced along the outer peripheral surface of the developing roller 151 in the direction of movement of the developing roller 151. The air current produced by the rotation of the developing roller 151 passes between the inner wall portion 53 of the developing housing 50 and the developing roller 151, and moves into the first stirring chamber 571.

Then, a gas flows into the developing housing 50 from the outside of the developing device 15, and the air pressure in the inside of the developing housing 50 is increased. Therefore, the air pressure in the inside of the developing housing 50 is higher than the air pressure at the outside of the developing device 15.

When the air pressure in the inside of the developing housing 50 increases, air current towards the outside of the developing housing 50 from the inside of the developing housing 50 is produced due to a difference in pressure between the inside and the outside of the developing housing 50. More specifically, as shown by arrow P2 in FIG. 4, gas in the inside of the first stirring chamber 571 enters the flow channel portion 55 via the entrance section 551 at a location between the first wall portion 61 and the second wall portion 62. Then, as shown by arrow P3 in FIG. 4, the gas that has entered the flow channel portion 55 passes through the flow channel portion 55 and is discharged to the outside of the developing device 15 via the exit section 553.

By this, in the developing device 15 of the exemplary embodiment, an excessive increase in the pressure in the inside of the developing housing 50 is suppressed.

In the developing device 15, for the purpose of, for example, increasing the productivity in the image forming apparatus 1, the number of rotations of the developing roller 151 (developing sleeve 151*b*) is sometimes increased.

As described above, the developer that has been returned to the inside of the developing housing 50 due to the rotation of the developing sleeve 151*b* and that has been separated from the developing roller 151 by the action of the separating pole N2 of the magnet roller 151*a* ordinarily falls into the first stirring chamber 571 due to gravitational force as shown by a broken-line arrow Q3 in FIG. 4. However, when the number of rotations of the developing roller 151 (developing sleeve 151*b*) is increased, by centrifugal force produced by the rotation of the developing sleeve 151*b* or by the rotation of the developing sleeve 151*b*, gas that has flown into the developing housing 50 from the outside of the developing housing 50 may cause the developer separated from the developing roller 151 to be scattered in a direction (Y direction) that crosses the gravitational direction.

Depending upon, for example, the shape of the developing housing 50, the gas that has flown into the developing housing 50 from the outside of the developing housing 50 moves directly towards the flow channel portion 55, as a result of which the developer that has been separated from the developing roller 151 and that has been scattered may enter the flow channel portion 55. When the developer enters the flow channel portion 55, the developer blocks the flow channel portion 55, as a result of which it may become difficult to suppress an increase in the pressure in the inside of the developing housing 50.

In contrast, in the developing device 15 of the exemplary embodiment, entry of the developer into the flow channel portion 55 is suppressed by providing the first wall portion 61 and the second wall portion 62 extending towards the outer peripheral edge of the first transporting member 155.

That is, in the developing device 15 of the exemplary embodiment, the gas that has flown into the developing housing 50 from the outside of the developing housing 50 is such as to strike the first wall portion 61. By this, after the developer that has separated from the developing roller 151 and that has been scattered in the Y direction by the rotation of the developing sleeve 151*b* has struck the first wall portion 61 as shown by a dashed-line arrow Q1, the developer changes its movement direction and falls into the first stirring chamber 571 as shown by a dashed-line arrow Q2. As a result, direct entry of the developer that has been scattered in the Y direction by the rotation of the developing sleeve 151*b* into the flow channel portion 55 is suppressed.

In particular, in the exemplary embodiment, as described above, the end portion 61*a* of the first wall portion 61 is positioned below the rotational center 151*c* of the developing roller 151 in the gravitational direction. By this, compared to a case in which the end portion 61*a* of the first wall portion 61 is positioned above the rotational center 151*c* of the developing roller 151 in the gravitational direction, the developer that has been separated from the developing roller 151 and that has been scattered in the Y direction by the rotation of the developing sleeve 151*b* tends to strike the first wall portion 61. As a result, direct entry of the developer into the flow channel portion 55 is suppressed even more.

In the exemplary embodiment, as described above, the first wall portion 61 is inclined in the gravitational direction (Z direction) away from the developing roller 151 from the end portion 61*a* towards the connection portion of the end portion 61*a* and the inner wall portion 53. By this, as shown by the broken-line arrow Q2, the developer that has struck the first wall portion 61 tends to fall in a direction away from the flow channel portion 55. As a result, compared to, for example, a case in which the first wall portion 61 is not inclined in the gravitational direction, entry of the developer that has struck the first wall portion 61 into the flow channel portion 55 is suppressed.

Here, as the flow rate of the gas flowing towards the flow channel portion increases, the developer that is accommodated in the inside of the developing housing 50 tends to enter the flow channel portion 55. In addition, in the vicinity of the end portion 61*a* of the first wall portion 61 and the end portion 62*a* of the second wall portion 62, as shown by arrow P2 in FIG. 4, the direction of movement of the gas towards the flow channel portion 55 from the first stirring chamber 571 changes in accordance with the shape of the first wall portion 61 or the shape of the second wall portion 62, as a result of which the flow rate of the gas tends to increase. Therefore, when the distance D1 and the distance D2 are equal to each other and the end portion 61*a* of the first wall portion 61 and the end portion 62*a* of the second wall portion face each other, at a facing portion between the end portion 61*a* of the first wall portion 61 and the end portion 62*a* of the second wall portion 62, the flow rate of the gas is increased and the developer may tend to enter the flow channel portion 55.

In contrast, in the exemplary embodiment, as described above, the distance D1 from the first wall portion 61 to the outer peripheral edge of the first transporting member 155 is smaller than the distance D2 from the second wall portion 62 to the outer peripheral edge of the first transporting member 155 (01<D2). In other words, the position of the end portion 61*a* of the first wall portion where the flow rate of the gas tends to become high and the position of the end portion 62*a* of the second wall portion 62 are displaced from each other.

By this, compared to when the distance D1 and the distance D2 are equal to each other, an excessive increase in the flow rate of the gas flowing towards the flow channel portion 55 is suppressed, and entry of the developer into the flow channel portion 55 is suppressed even more.

In the exemplary embodiment, as described above, the end portion 61*a* of the first wall portion 61 is positioned on a side opposite to the developing roller 151 with respect to the perpendicular line Z1 (see FIG. 3) passing through the rotational center of the first transporting member 155 and extending in the gravitational direction (Z direction).

By this, compared to, for example, when the end portion 61*a* of the first wall portion 61 and the developing roller 151 are positioned on the same side with respect to the perpendicular line Z1, a case in which, after the developer has been separated from the developing roller 151 by the action of the separating pole N2, the developer that has struck the first wall portion 61 adheres again to the developing roller 151 without falling into the first stirring chamber 571 is suppressed. As a result, as regards a developer layer that is formed on the surface of the developing roller 151, a developer is properly replaced, so that the occurrence of defects in, for example, a toner image that is formed on the photoconductor drum 12 is suppressed.

Further, in the exemplary embodiment, when the developing housing 50 includes both the first wall portion 61 and the second wall portion 62, it is possible to make the length of the flow channel portion 55 longer than when, for example, the developing housing 50 does not include a second wall portion 62. In this example, the length of the flow channel portion 55 refers to a length of the flow channel portion 55 from the entrance section 551, where the end portion 62*a* of the second wall portion 62 faces the first wall portion 61, to the exit section 553.

In the exemplary embodiment, due to pressure loss caused by the length of the flow channel portion 55, the pressure at the exit section 553 of gas that has entered the flow channel portion 55 is lower than the pressure at the entrance section 551. By this, the pressure of the gas that is discharged to the outside of the developing device 15 from the exit section 553 via the flow channel portion 55 approaches the air pressure at the outside of the developing device 15. As a result, the discharge of the developer in the inside of the developing housing 50 to the outside of the developing device 15 along with the gas that passes through the flow channel portion 55 is suppressed.

As another method of suppressing entry of a developer into the flow channel portion 55, there is, for example, a method of providing a filter at the entrance section 551 of the flow channel portion 55 or the like, the filter trapping the developer. However, when a filter is provided at the flow channel portion 55, the lifetime is based on the accumulation of the developer in the filter and the clogging of the filter by the developer. Therefore, the filter and the developing device 15 are periodically replaced.

In contrast, in the exemplary embodiment, by providing a structure in which the developer that has been separated from the developing roller 151 and that has been scattered by the rotation of the developing sleeve 151*b* strikes the first wall portion 61, a filter or the like for suppressing entry of a developer into the flow channel portion 55 need not be provided. Therefore, the structure of the developing device 15 is simplified, and the filter and the developing device 15 need not be replaced on the basis of the lifetime of the filter.

Second Exemplary Embodiment

Figure 5:
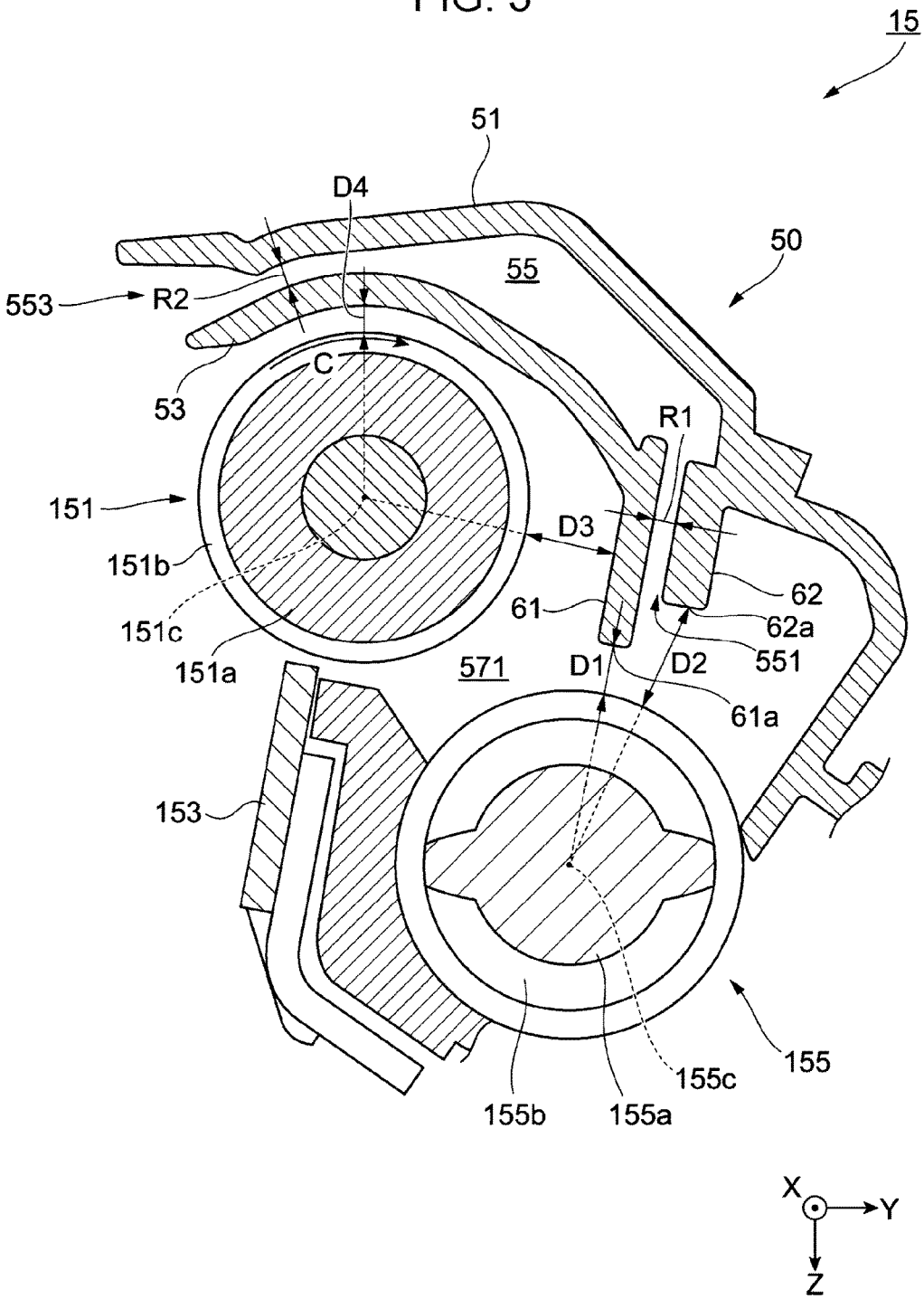
FIG. 5 illustrates a structure of a developing device to which a second exemplary embodiment is applied.

Next, a second exemplary embodiment of the present invention is described. Structures that are similar to those of the first exemplary embodiment are given the same reference numerals, and detailed descriptions thereof are not given here. FIG. 5 illustrates a structure of a developing device 15 to which the second exemplary embodiment is applied.

In the developing device 15 of the second exemplary embodiment, a distance R1 between a first wall portion 61 and a second wall portion 62 (width of an entrance section 551 of a flow channel portion 55) is smaller than a distance R2 between an inner wall portion 53 and an outer wall portion 51 (width of an exit section 553 of the flow channel portion 55) (R1<R2). The inner wall portion 53 and the outer wall portion 51 form the flow channel portion 55. Further, in the developing device 15 of the second exemplary embodiment, the distance R1 between the first wall portion 61 and the second wall portion 62 is smaller than a distance D4 between a developing roller 151 and the inner wall portion 53 (R1<D4).

By providing such a structure, in the developing device 15 of the second exemplary embodiment, compared to, for example, when the distance R1 between the first wall portion 61 and the second wall portion 62 is larger than the distance R2 between the inner wall portion 53 and the outer wall portion 51 and the distance D4 between the developing roller 151 and the inner wall portion 53, direct entry of a developer scattered in the Y direction by the rotation of a developing sleeve 151*b* into the flow channel portion 55 is suppressed.

Although the smaller the distance R1 between the first wall portion 61 and the second wall portion 62, the greater the suppression of entry of a developer into the flow channel portion 55, the flow channel portion 55 may tend to become clogged by a developer that has entered the flow channel portion 55, or the discharge amount of gas via the flow channel portion 55 may be reduced. Therefore, the distance R1 between the first wall portion 61 and the second wall portion 62 is desirably determined in accordance with, for example, the particle size of carriers used in a developer, the size of a developing housing 50, the discharge amount demanded from the flow channel portion 55, and the number of rotations of the developing roller 151.

Third Exemplary Embodiment

Figure 6:
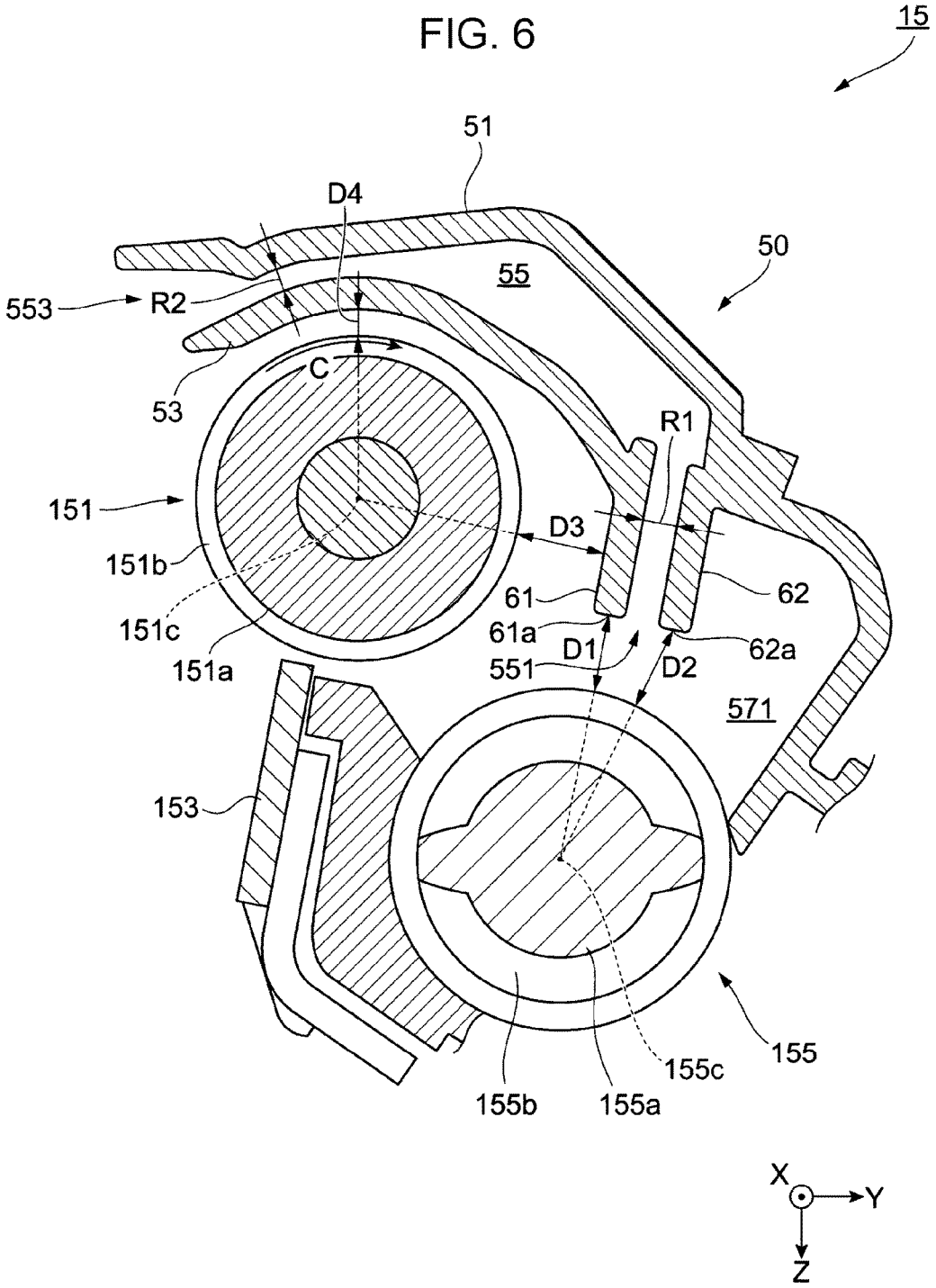
FIG. 6 illustrates a structure of a developing device to which a third exemplary embodiment is applied.

Next, a third exemplary embodiment of the present invention is described. Structures that are similar to those of the first exemplary embodiment are given the same reference numerals, and detailed descriptions thereof are not given here. FIG. 6 illustrates a structure of a developing device 15 to which the third exemplary embodiment is applied.

In the developing device 15 of the first exemplary embodiment described above, the distance D1 from the first wall portion 61 to the outer peripheral edge of the first transporting member 155 is smaller than the distance D2 from the second wall portion 62 to the outer peripheral edge of the first transporting member 155 (01<D2). However, the distance D1 from the first wall portion 61 to the outer peripheral edge of the first transporting member 155 may be less than or equal to the distance D2 from the second wall portion 62 to the outer peripheral edge of the first transporting member 155. For example, as shown in FIG. 6, the distance D1 and the distance D2 may be equal to each other (01=D2).

That is, when the distance D1 from the first wall portion 61 to the outer peripheral edge of the first transporting member 155 is larger than the distance D2 from the second wall portion 62 to the outer peripheral edge of the first transporting member 155, the second wall portion 62 is in a state in which it protrudes with respect to the first wall portion 61. In this case, a developer scattered in the Y direction by the rotation of a developing sleeve 151*b* tends to strike the second wall portion 62 and enter a flow channel portion 55.

In contrast, when, as shown in FIG. 6, the distance D1 and the distance D2 are equal to each other, as in the first exemplary embodiment described above, a developer scattered in the Y direction by the rotation of the developing sleeve 151*b* strikes the first wall portion 61 and falls into the first stirring chamber 571. Therefore, entry of the developer into the flow channel portion 55 is suppressed.

In the exemplary embodiments described above, an example in which the first wall portion 61 and the second wall portion 62 of the developing housing 50 are parallel to each other is described. However, as long as the distance D1 from the first wall portion 61 to the outer peripheral edge of the first transporting member 155 is less than or equal to the distance D2 from the second wall portion 62 to the outer peripheral edge of the first transporting member 155 and gas is capable of passing between the first wall portion 61 and the second wall portion 62, the first wall portion 61 and the second wall portion 62 need not be parallel to each other.

Further, although the shape of the first wall portion 61 and the shape of the second wall portion 62 are not limited to the planar shapes above, and may be, for example, curved shapes, from the viewpoint of suppressing the accumulation of a developer on the first wall portion 61 and the second wall portion 62, it is desirable that the shapes be planar shapes.

Although, in the exemplary embodiments described above, an example in which application is made to the image forming apparatus 1, which is a so-called tandem-system color printer is described, the image forming apparatus 1 to which the exemplary embodiments are applied is not particularly limited thereto, and may be, for example, a monochromatic printer having a commonly known structure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

an accommodating section that accommodates a developer;

a developing section that rotates such that an upper portion thereof in a gravitational direction moves from an outer side of the accommodating section to an inner side of the accommodating section, the developing section performing developing on an image holding body with the developer;

a transporting section that is disposed below the developing section in the gravitational direction and that transports the developer in an inside of the accommodating section;

a flow channel portion that extends from the inner side of the accommodating section to the outer side of the accommodating section;

a first wall portion that extends towards the transporting section at an end portion on an inner side of the flow channel portion and that faces the developing section; and a second wall portion that extends towards the transporting section at the end portion on the inner side of the flow channel portion and that faces the first wall portion on a side opposite to the developing section, a distance from the second wall portion to an outer peripheral edge of the transporting section being greater than or equal to a distance from the first wall portion to the outer peripheral edge of the transporting section.

2. The developing device according to claim 1, wherein the distance from the first wall portion to the outer peripheral edge of the transporting section is smaller than the distance from the second wall portion to the outer peripheral edge of the transporting section.

3. The developing device according to claim 2, wherein an end portion of the first wall portion facing the outer peripheral edge of the transporting section is positioned below a rotational center of the developing section in the gravitational direction.

4. The developing device according to claim 3, wherein the accommodating section includes a facing portion that is positioned above the developing section in the gravitational direction and that faces an outer peripheral surface of the developing section, and wherein the first wall portion is formed continuously from the facing portion of the accommodating section.

5. The developing device according to claim 4, wherein the first wall portion is inclined away from the developing section from the end portion of the first wall portion facing the outer peripheral edge of the transporting section towards the facing portion.

6. The developing device according to claim 2, wherein the first wall portion is positioned on the side opposite to the developing section with respect to a perpendicular line passing through a rotational center of the transporting section and extending in the gravitational direction.

7. The developing device according to claim 1, wherein a distance between the first wall portion and the second wall portion is smaller than a distance between the developing section and the first wall portion.

8. The developing device according to claim 7, wherein the accommodating section includes a facing portion that is positioned above the developing section in the gravitational direction and that faces an outer peripheral surface of the developing section, and wherein the distance between the first wall portion and the second wall portion is smaller than a distance between the developing section and the facing portion.

9. The developing device according to claim 1, wherein the flow channel portion is formed so as to extend above the developing section in the gravitational direction in accordance with an outer periphery of the developing section from the inner side of the accommodating section, and an air pressure at an end portion on an outer side of the flow channel portion is lower than an air pressure between the first wall portion and the second wall portion.

10. The developing device according to claim 9, wherein the accommodating section includes a facing portion that faces the upper portion of the developing section in the gravitational direction, and wherein the flow channel portion is formed on the side opposite to the developing section with the facing portion interposed therebetween.

11. An image forming apparatus comprising:

an image holding body; and a developing device that forms an image on the image holding body by using a developer, wherein the developing device is the developing device according to claim 1.

* * * * *